US012324487B1

(12) United States Patent
Lin et al.

(10) Patent No.: US 12,324,487 B1
(45) Date of Patent: Jun. 10, 2025

(54) ROTATABLE ANTI-SLIP DEVICE AND ALL-TERRAIN ANTI-SLIP SOLE

(71) Applicant: Jinjiang Xinming shoe material Technology Co., LTD., Quanzhou (CN)

(72) Inventors: Kunfeng Lin, Quanzhou (CN); Shubiao Lin, Quanzhou (CN)

(73) Assignee: Jinjiang Xinming shoe material Technology Co., LTD., Fujian (CN)

( * ) Notice: Subject to any disclaimer, the term of this patent is extended or adjusted under 35 U.S.C. 154(b) by 0 days.

(21) Appl. No.: 19/013,138

(22) Filed: Jan. 8, 2025

(30) Foreign Application Priority Data

Sep. 6, 2024 (CN) ..... 202411246353.X

(51) Int. Cl.
*A43C 15/14* (2006.01)

(52) U.S. Cl.
CPC ..... *A43C 15/14* (2013.01)

(58) Field of Classification Search
CPC ..... A43C 15/08; A43C 15/14
USPC ..... 36/61
See application file for complete search history.

(56) References Cited

U.S. PATENT DOCUMENTS 997,055 A * 7/1911 Gilowitz ..... A43C 15/08 36/134
4,745,692 A * 5/1988 Liao ..... A43C 15/02 36/62
6,675,504 B1 * 1/2004 Biancucci ..... A43C 15/08 36/61
7,269,916 B2 * 9/2007 Biancucci ..... A43B 3/246 36/61
2006/0162188 A1 * 7/2006 Biancucci ..... A43B 3/246 36/61

FOREIGN PATENT DOCUMENTS

CN 1708244 A 12/2005

* cited by examiner

*Primary Examiner* — Ted Kavanaugh
(74) *Attorney, Agent, or Firm* — Valet Patent Service Limited

(57) ABSTRACT

The present application relates to a rotatable anti-slip device and an all-terrain anti-slip sole, wherein the anti-slip mechanism can turn over relative to the mounting seat by providing a rotation part. Specifically, by providing a sphere, the rotating shaft can rotate along the spherical surface. At the same time, the rotating shaft is arranged between the sphere and the friction part, and the rotating shaft can limit the rotation direction, so that the friction part can be turned over along the rotating shaft. The friction part has a first friction surface and a second friction surface. Users can adjust the friction part according to different terrains to meet the anti-slip needs of different terrains, which effectively improves the anti-slip effect on different terrains. Additionally, the anti-slip device can be easily and conveniently replaced, and the anti-slip function of the shoes will not be lost due to accidents or damage.

20 Claims, 8 Drawing Sheets

ROTATABLE ANTI-SLIP DEVICE AND ALL-TERRAIN ANTI-SLIP SOLE

TECHNICAL FIELD

The present application relates to the technical field of shoemaking, and more particularly to a rotatable anti-slip device and an all-terrain anti-slip sole.

BACKGROUND

As an important component of shoes, the sole has characteristics such as wear resistance and pressure resistance, among which the anti-slip function is one of the main functions of the sole. In the existing technology, sole patterns are generally used on hard surfaces to increase friction, thereby achieving the purpose of anti-slip; However, when encountering icy roads due to rain or snow, or during outdoor activities such as mountaineering or fishing, it is difficult to achieve anti-slip effects solely through the sole pattern. The usual practice is to use shoe spikes inserted into the ground for anti-slip purposes. However, wearing spiked shoes on hard surfaces can cause discomfort to the feet and easily lead to damage to the shoe spikes.

In current sports such as mountaineering, it is necessary to deal with complex terrains, and carrying two pairs of shoes with different soles can be extremely inconvenient. In existing technologies, patents with publication numbers U.S. Pat. No. 7,269,916B2 (Apr. 19, 2005), EP1558103A1 (Aug. 3, 2005), and CN117617628A (Aug. 11, 2022) all feature soles with anti-slip devices. The connection between the anti-slip device and the sole is a dual-axis connection, which is inconvenient to assemble. Therefore, designing a rotatable anti-slip device and anti-slip sole to solve the above problems is very necessary.

SUMMARY

(1) Technical Problem to be Solved

In order to solve the above-mentioned problems of the prior art, the present application provides a rotatable anti-slip device, which can cope with different sports scenarios by switching different anti-slip surfaces, making it convenient for people to adjust and use.

The present application also provides an anti-slip sole, which can cope with different sports scenarios by adjusting the rotatable anti-slip device, making it convenient to use.

(2) Technical Solution

To achieve the above objectives, the main technical solutions adopted by the present application comprise:

A rotatable anti-slip device, comprising a device main body, wherein the device main body comprises a mounting seat and an anti-slip mechanism rotatably connected to the mounting seat, wherein the anti-slip mechanism comprises a friction part and a rotation part connected to the friction part, wherein the rotation part comprises a sphere and a rotating shaft connected between the sphere and the friction par, wherein the friction part comprises a first friction surface and a second friction surface facing opposite to the first friction surface, and the friction part comprises anti-slip components arranged on the second friction surface. In the actual implementation process, the anti-slip mechanism can turn over relative to the mounting seat by providing a rotation part. Specifically, by providing a sphere, the rotating shaft can rotate along the spherical surface. At the same time, the rotating shaft is arranged between the sphere and the friction part, and the rotating shaft can limit the rotation direction, so that the friction part can be turned over along the rotating shaft. The friction part has a first friction surface and a second friction surface. Users can adjust the friction part according to different terrains to meet the anti-slip needs of different terrains, which effectively improves the anti-slip effect on different terrains. Additionally, the anti-slip device can be easily and conveniently replaced, and the anti-slip function of the shoes will not be lost due to accidents or damage.

Preferably, the anti-slip component comprises shoe spikes or spike stickers. The friction part and rotation part in the anti-slip mechanism are made of TPU material, and the anti-slip components are made of either tungsten steel or stainless steel. The friction part, rotation part, and anti-slip components are integrally formed by mold processing. In the actual implementation process, the anti-slip components enhance the grip of the second friction surface and effectively improve the anti-slip performance.

Preferably, the anti-slip mechanism is integrally formed. In the actual implementation process, the anti-slip mechanism adopts an integrated injection molding method, which saves the time of assembling parts, effectively improves the production efficiency of the anti-slip mechanism and reduces production costs.

Preferably, the friction part comprises positioning holes and friction strips arranged around the positioning hole; the friction strips are connected to the shoe spike. The friction strip comprises a first end connected to the rotating shaft and a second end corresponding to the first end. In the actual implementation process, by providing the positioning holes can effectively reduce the use of injection molding materials, which is convenient for manufacturing, saving production costs of the friction part, and facilitating positioning and installation. The design of the friction strip is convenient for carrying the spikes.

Preferably, the friction part comprises a plurality of positioning holes and a plurality of friction strips, wherein the plurality of friction strips are staggered and connected to form external ribs and internal cross ribs. In the actual implementation process, the plurality of positioning holes facilitate installation, and after installation, they make the connection of the friction part more secure and reliable. At the same time, the plurality of friction strips are staggered and connected to form internal cross bars that support the friction part, which effectively enhances the strength of the friction part.

Preferably, the friction strip is mainly formed by alternately connecting thick protrusion sections and thin concave sections, wherein the thick protrusion sections and the thin concave sections are connected end to end, and the shoe spikes are arranged on the thick protrusion sections on the external ribs and internal cross ribs. In the actual implementation process, when the friction strip is installed within the friction groove section, it can be effectively fixed, which makes the installation of the friction strip more secure and reliable. At the same time, when the friction groove section deforms under force, the wave-like surface formed by the thick protrusion section and the thin concave section can effectively increase the friction area, which prevents the friction strip from slipping out of the friction groove section.

Preferably, the friction strip also comprises a positioning bump provided on the second end and extending towards the interior of the positioning hole. In the actual implementation process, to prevent the friction part from moving along the spherical surface after installation, a positioning bump is arranged on the second end to fix it, thereby making the installation of the friction part more secure and reliable.

Preferably, the friction strip also comprises an ejection point provided at the second end, wherein the ejection point is arranged on the first friction surface. In the actual implementation process, when the first friction surface faces outward, the ejection point contacts the ground earlier than the first friction surface, supporting the second end and preventing it from slipping out of the friction groove section, thereby effectively protecting the friction strip.

Preferably, the mounting seat comprises a sliding groove part that cooperates with the sphere; The sliding groove part has a first opening for the sphere to enter and exit and a second opening for avoiding the rotating shaft; an upper part of the sliding groove part is configured to be a cylindrical structure, and the lower part is configured to be a spherical structure, wherein the second opening is configured to limit the position of the sphere. In the actual implementation process, the purpose of providing the first opening is to facilitate the assembly of the anti-slip mechanism and the mounting seat. The second opening is provided for avoiding the rotating shaft, and at the same time, the second opening can limit the position of the rotating shaft, which makes the friction part more secure and stable after installation.

Preferably, the mounting seat is integrally formed. In the actual implementation process, the mounting seat is manufactured using integrated injection molding, which saves assembly time and effectively improves the production efficiency of the mounting seat, reduces production costs.

Preferably, the mounting seat also comprises an avoiding arc surface for avoiding the friction part, the angle of the avoiding arc surface is 0-60°, and the angle of rotation of the friction part along the avoiding arc surface is 90-120°. In the actual implementation process, when it is necessary to switch between the first friction surface and the second friction surface, the user can move the second end to make the rotating shaft swing along the second opening, which drives the sphere to rotate, thereby allowing the friction strip to disengage from the friction groove section; then rotate the friction strip along the rotating shaft. When the rotating shaft swings along the second opening, the friction part can move in the direction of the avoiding arc surface, which allowes the avoiding arc surface to avoid the friction part, makes the switching process more efficient and smoother.

Preferably, the mounting seat comprises a clamping cone head for fixed installation. In the actual implementation process, the installation of the mounting seat is facilitated by providing the clamping cone head.

An anti-slip sole comprises a sole body connected to a rotatable anti-slip device, wherein the sole body comprises a mounting groove for installing the rotatable anti-slip device. In the actual implementation process, the installation of the anti-slip device is facilitated by providing the mounting groove.

Preferably, the mounting groove comprises a seat groove section that cooperates with the mounting seat, a limiting stop wall surrounding the outside of the seat groove section, and a clamping hole arranged at the bottom of the seat groove section, wherein the clamping hole is configured to fix the clamping cone head. In the actual implementation process, the cooperation between the clamping hole and the clamping cone head facilitates the installation of the mounting seat, which makes the connection of the mounting seat more secure and reliable.

Preferably, the mounting groove further comprises an anti-slip groove section that cooperates with the anti-slip mechanism, wherein the anti-slip groove section comprises a friction groove section that cooperates with the friction strip. In the actual implementation process, after the friction strip is installed, it is embedded in the friction groove section, which facilitates the installation of the friction strip and also provides protection for the friction strip.

Preferably, the friction groove section comprises a sidewall for limiting the position of the friction strip, wherein the sidewall is higher than the friction strip, and the height difference between them is 2-3.5 mm. In the actual implementation process, the limiting effect of the sidewall effectively secures the friction strip, which makes the connection of the friction strip firmer.

Preferably, the friction groove section further comprises a groove bottom surface for supporting the friction strip, wherein the groove bottom surface comprises a concave surface that cooperates with the thick protrusion section and a convex surface that cooperates with the thin concave section. In the actual implementation process, when the friction strip is installed within the friction groove section, it can be effectively fixed, which makes the installation of the friction strip more secure and reliable. At the same time, when the friction groove section deforms under force, the wave-like surface formed by the thick protrusion section and the thin concave section can effectively increase the friction area, which prevents the friction strip from slipping out of the friction groove section.

Preferably, the friction groove section further comprises sockets provided on the groove bottom surface, wherein the socket cooperates with the anti-slip component. In the actual implementation process, the socket on the friction groove bottom surface can accommodate the shoe spike.

Preferably, the mounting groove further comprises a positioning bump that cooperates with the positioning hole. In the actual implementation process, the cooperation between the positioning hole and the positioning bump facilitates the fixed installation of the friction part.

Preferably, the sole body further comprises a clamping groove provided on the positioning bump, wherein the clamping groove cooperates with the positioning bump. In the actual implementation process, the clamping groove cooperates with the positioning bump, which ensures that the friction part is better fixed on the sole and prevents the second end from detaching.

Preferably, the anti-slip groove section further comprises a rotation groove section that cooperates with the rotation part, wherein the rotation groove section is connected between the friction groove section and the seat groove section.

Preferably, after the anti-slip device is installed, the ejection point is flush with the bottom surface of the anti-slip sole. In the actual implementation process, the ejection point is arranged flush with the ground surface of the anti-slip sole. During the contact between the sole and the ground, the ejection point will contact the ground before the second end, which effectively prevents the unintended detachment of the second end from the friction groove section, thereby ensuring that the anti-slip device is securely and reliably fixed to the anti-slip sole during walking.

Preferably, the mounting groove further comprises an avoiding groove; the friction groove section is connected between the avoiding groove and the rotation groove section. In the actual implementation process, the avoiding groove can accommodate a finger to facilitate the removal of the second end, allowing for easy switching between the first friction surface or the second friction surface.

Preferably, the sole body comprises more than two mounting grooves. In the actual implementation process, a mounting groove can be arranged at the heel, and another can be arranged at the shoe vamp, allowing a single sole to accommodate two rotatable anti-slip devices, resulting in better performance.

(3) Beneficial Effects

The beneficial effect of the present application is that, in the actual implementation process, by providing the rotation part, the anti-slip mechanism can turn over relative to the mounting seat; Specifically, by providing a sphere, the rotating shaft can rotate along the spherical surface. At the same time, the rotating shaft is arranged between the sphere and the friction part, which allows the rotating shaft to limit the rotation direction, so that the friction part can turn over along the rotating shaft. The friction part has a first friction surface and a second friction surface. Users can adjust the friction part according to different terrains to meet the anti-slip needs of different terrains, which effectively improves the anti-slip effect on various terrains. Additionally, the anti-slip device can be easily and conveniently replaced, which ensures that the shoe's anti-slip function is not lost due to accidents or damage.

In Figures

Figure 1:
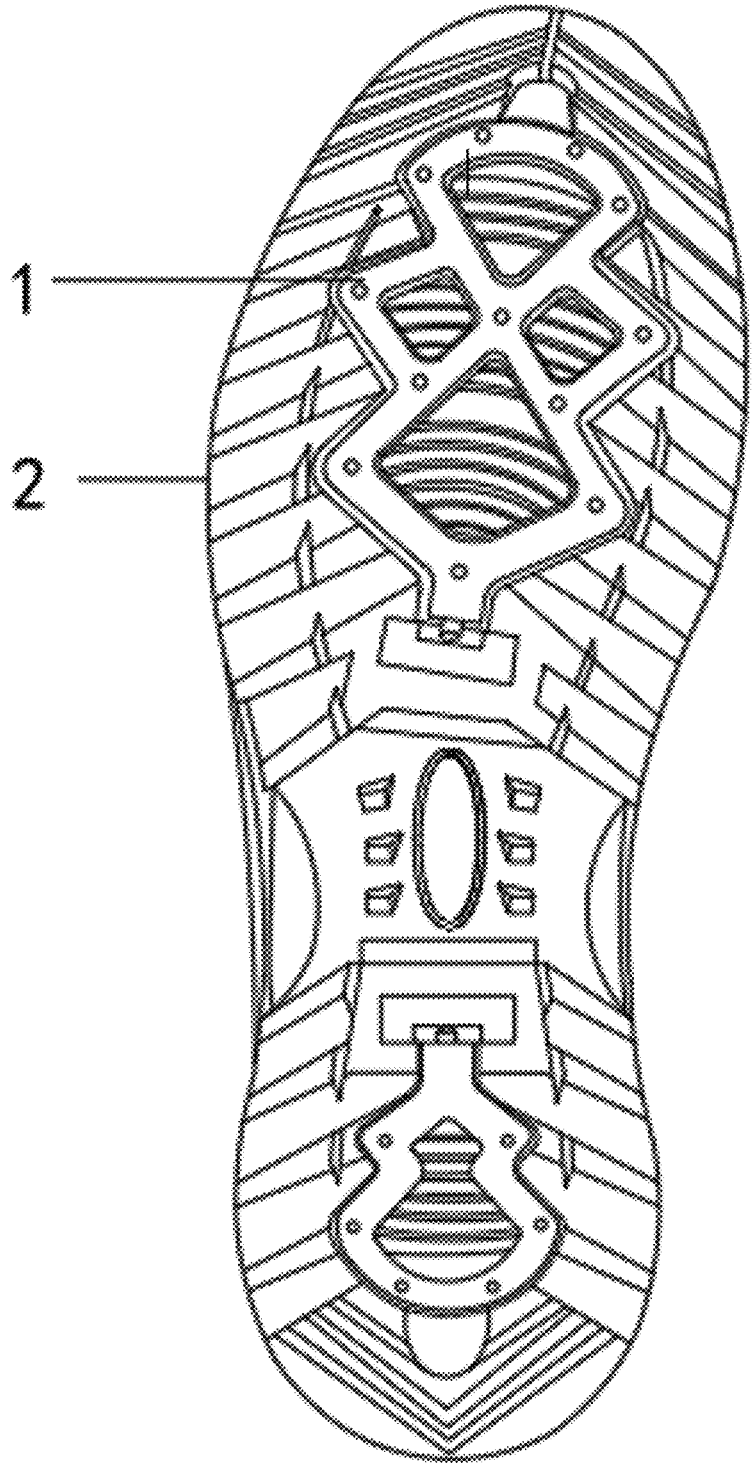
FIG. 1 is a schematic diagram of the connection structure between the anti-slip device and the anti-slip sole of the present application.
Figure 2:
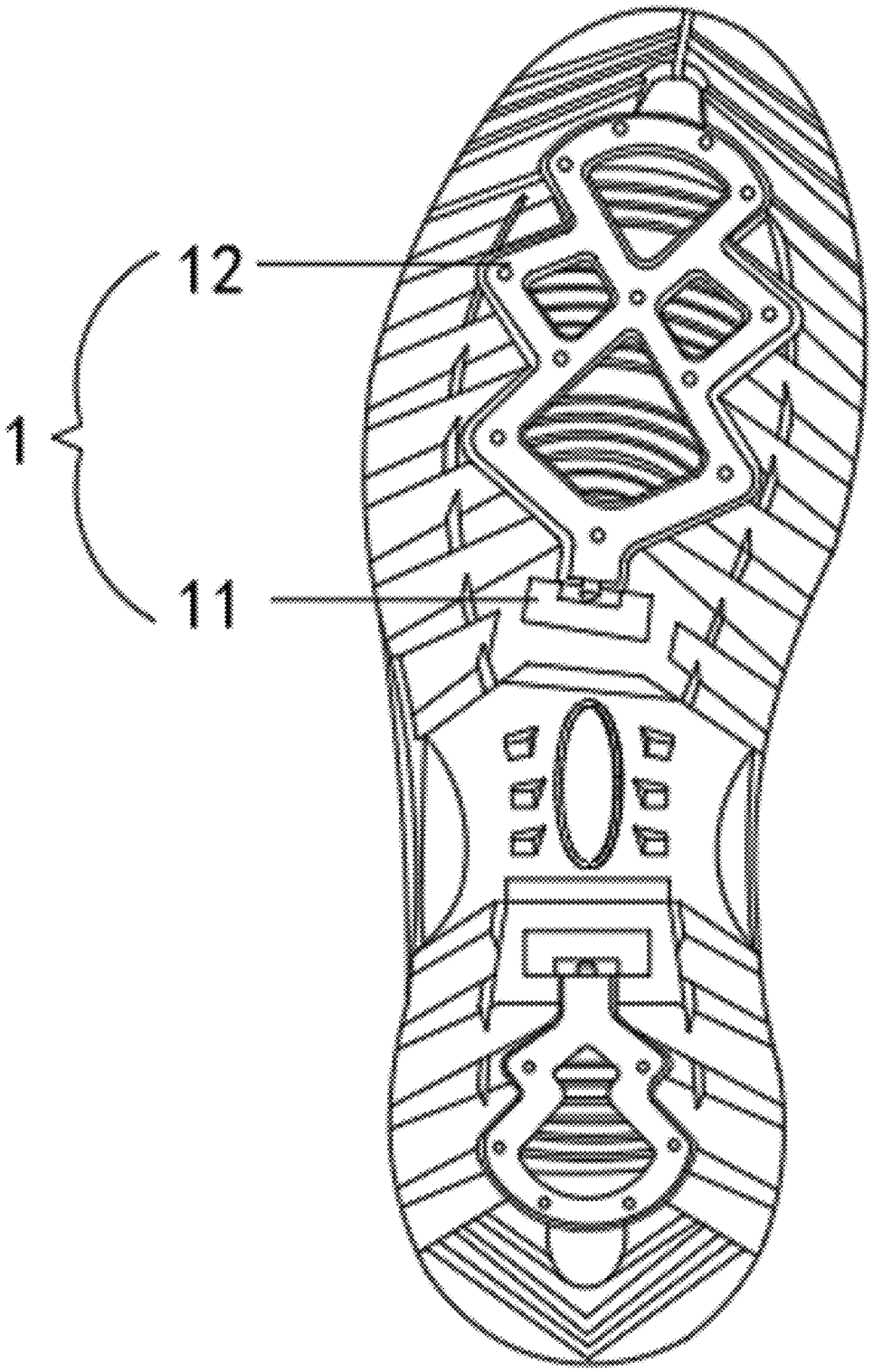
FIG. 2 is a detailed schematic diagram of the anti-slip device in FIG. 1.
Figure 3:
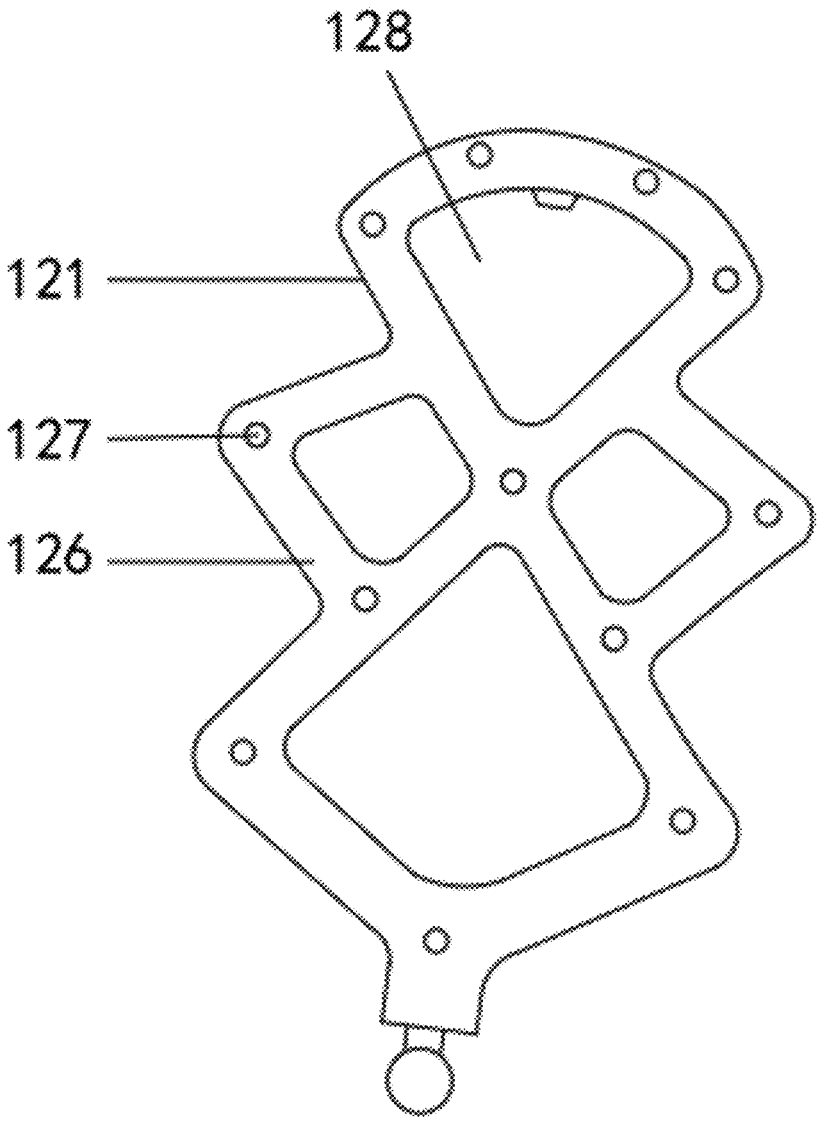
FIG. 3 is a detailed schematic diagram of the first perspective of the friction part in the anti-slip device.
Figure 4:
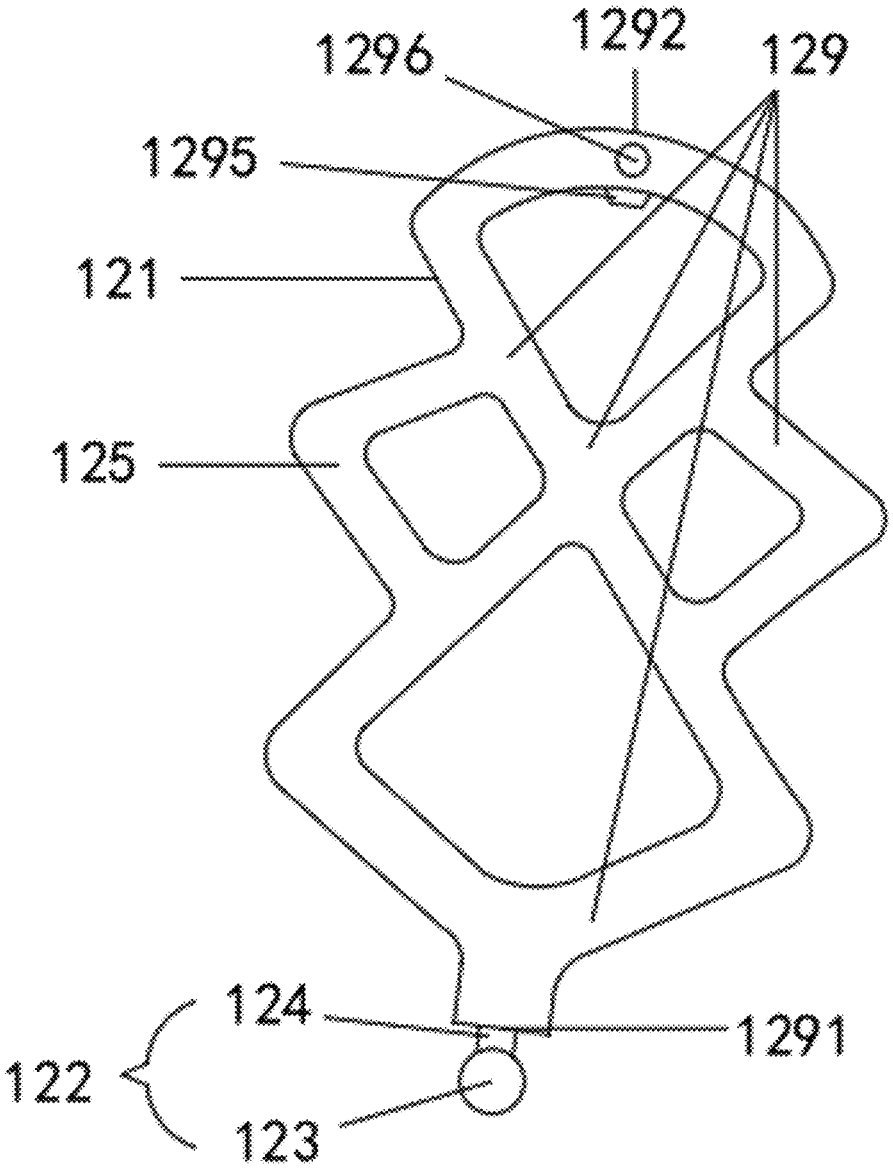
FIG. 4 is a detailed schematic diagram of the second perspective of the friction part in the anti-slip device.

Device Main Body—1, Mounting Seat—11, Anti-slip Mechanism—12, Friction Part—121, Rotation Part—122, Sphere—123, Rotating Shaft—124, First Friction Surface—125, Second Friction Surface—126, Anti-slip Component—127, Positioning hole—128, Friction Strip—129, First End—1291, Second End—1292, Thick Protrusion Section—1293, Thin Concave Section—1294, Positioning Bump—1295, Ejection Point—1296, Sliding Groove Part—111, First Opening—112, Second Opening—113, Avoiding arc surface—114, Clamping cone head—115, Mounting Groove—21, Seat Groove Section—211, Limiting stop wall—212, Clamping hole—213, Anti—slip Groove Section—214, Friction Groove Section—215, Sidewall—216, Groove Bottom Surface—217, Concave Surface—2171, Convex Surface—2172, Socket—218, Positioning Bump—219, clamping groove—22, Rotation Groove Section—2141, Avoiding groove—2101.

DETAILED DESCRIPTION

To better explain the present application and facilitate understanding, the following detailed description of the present application is provided in conjunction with the figures and specific implementation methods.

Please refer to FIGS. 1-8, which illustrate a rotatable anti-slip device and an all-terrain anti-slip sole according to the present application.

In the specific implementation method

[Anti-Slip Device According to the Embodiment of the Present Application]

Embodiment 1

A rotatable anti-slip device comprises a device main body 1, wherein the device main body 1 comprises a mounting seat 11 and an anti-slip mechanism 12 that is rotatably connected to the mounting seat 11; The anti-slip mechanism 12 comprises a friction part 121 and a rotation part 122 connected to the friction part 121; The rotation part 122 comprises a sphere 123 and a rotating shaft 124 connected between the sphere 123 and the friction part 121; The friction part 121 comprises a first friction surface 125 and a second friction surface 126 opposite to the first friction surface 125; The friction part 121 comprises an anti-slip component 127 provided on the second friction surface 126. In the actual implementation process, by providing the rotation part 122, the anti-slip mechanism 12 can turn over relative to the mounting seat 11; Specifically, by providing the sphere 123, the rotating shaft 124 can rotate along the spherical surface, and at the same time, the rotating shaft 124 is arranged between the sphere 123 and the friction part 121, the rotating shaft 124 can limit the rotation direction, allowing the friction part 121 to turn over along the rotating shaft 124; The friction part 121 has a first friction surface 125 and a second friction surface 126. The user can turn over the friction part 121 according to different terrains to meet the anti-slip requirements of different terrains, effectively improving the anti-slip effect on various terrains.

The anti-slip component 127 comprises shoe spikes or spike stickers. The friction part 121 and the rotation part 122 in the anti-slip mechanism 12 are made of TPU material, while the anti-slip component 127 is made of tungsten steel. The friction part 121, rotation part 122, and anti-slip component 127 are integrally formed by mold processing. In the actual implementation process, the anti-slip component 127 enhances the grip of the second friction surface 126, effectively improving anti-slip performance.

The anti-slip mechanism 12 is integrally molded. In the actual implementation process, the anti-slip mechanism 12 adopts an integrated injection molding method, which saves assembly time for parts, effectively improves the production efficiency of the anti-slip mechanism 12 and reduces production costs.

The friction part 121 comprises a positioning hole 128 and a friction strip 129 arranged around the positioning hole 128; the friction strip 129 is connected to the shoe spike. The friction strip 129 comprises a first end 1291 connected to the rotating shaft 124 and a second end 1292 corresponding to the first end 1291. In the actual implementation process, providing the positioning hole 128 can effectively reduce the use of injection molding material, facilitate manufacturing, save the production cost of the friction part 121, and make positioning installation convenient. The design of the friction strip 129 facilitates the bearing of the shoe spike.

The friction part 121 comprises a plurality of positioning holes 128 and a plurality of friction strips 129; The plurality of friction strips 129 are staggered and connected to form external ribs and internal cross ribs. In the actual implementation process, the plurality of positioning holes 128 facilitate installation, and after installation, they make the connection of the friction part 121 more secure and reliable. Meanwhile, the plurality of friction strips 129 are staggered and connected to form internal cross bars that support the friction part 121, effectively enhancing the strength of the friction part 121.

Figure 5:
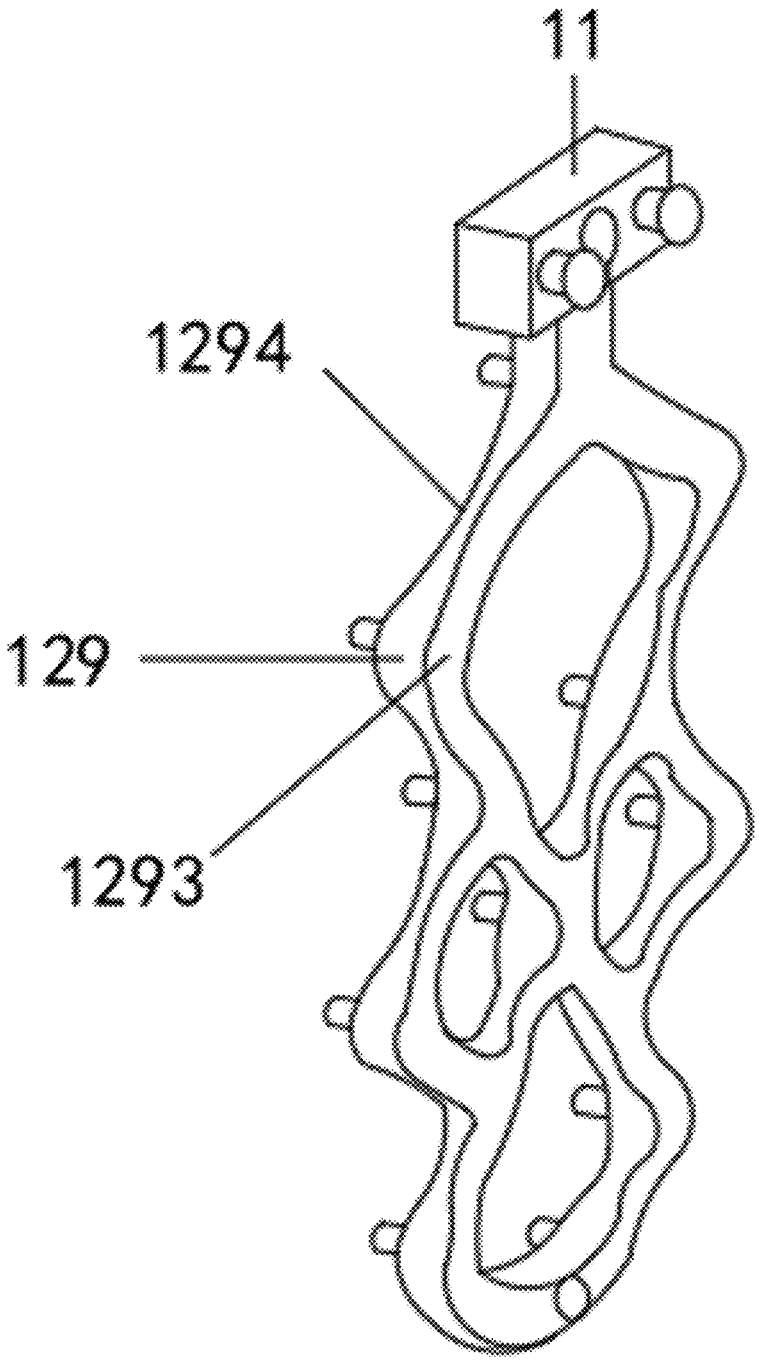
FIG. 5 is a three-dimensional schematic diagram of the connection structure between the anti-slip mechanism and the mounting seat in the anti-slip device.
Figure 6:
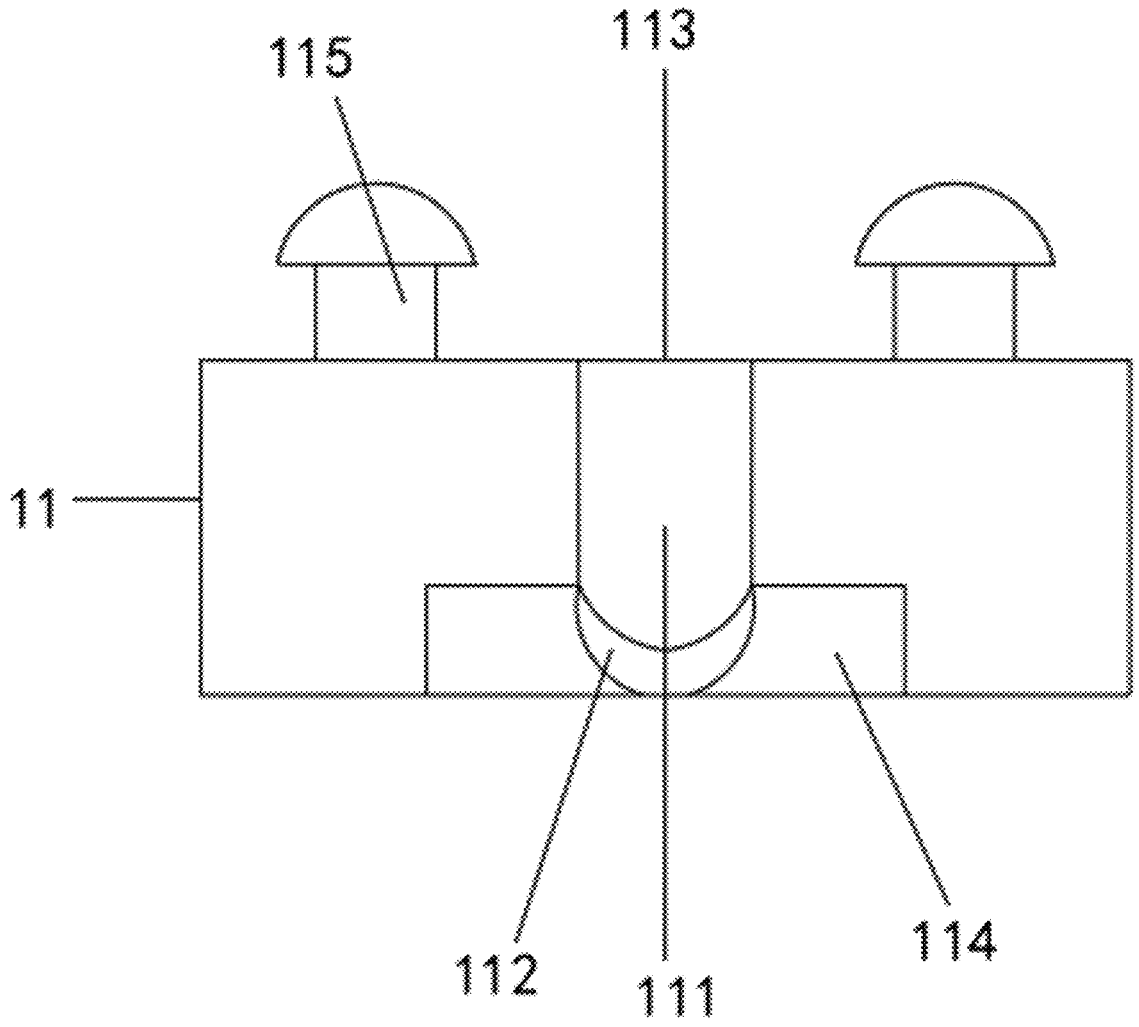
FIG. 6 is a detailed schematic diagram of the first perspective of the mounting seat in the anti-slip device.
Figure 7:
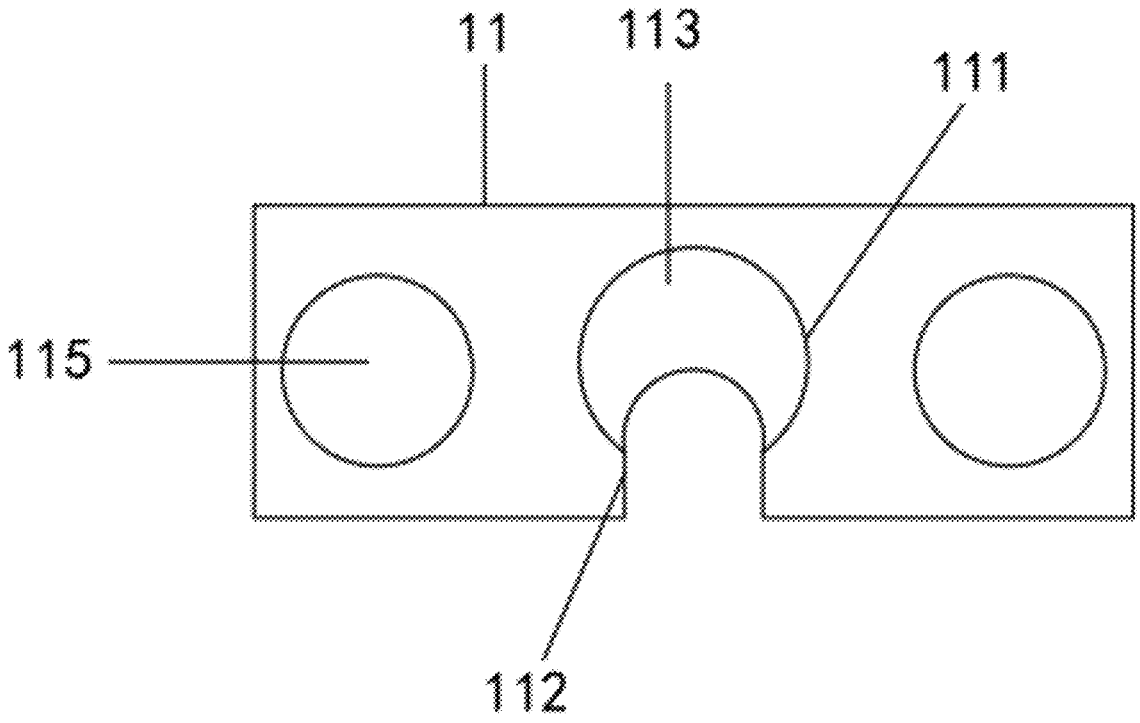
FIG. 7 is a detailed schematic diagram of the second perspective of the mounting seat in the anti-slip device.
Figure 8:
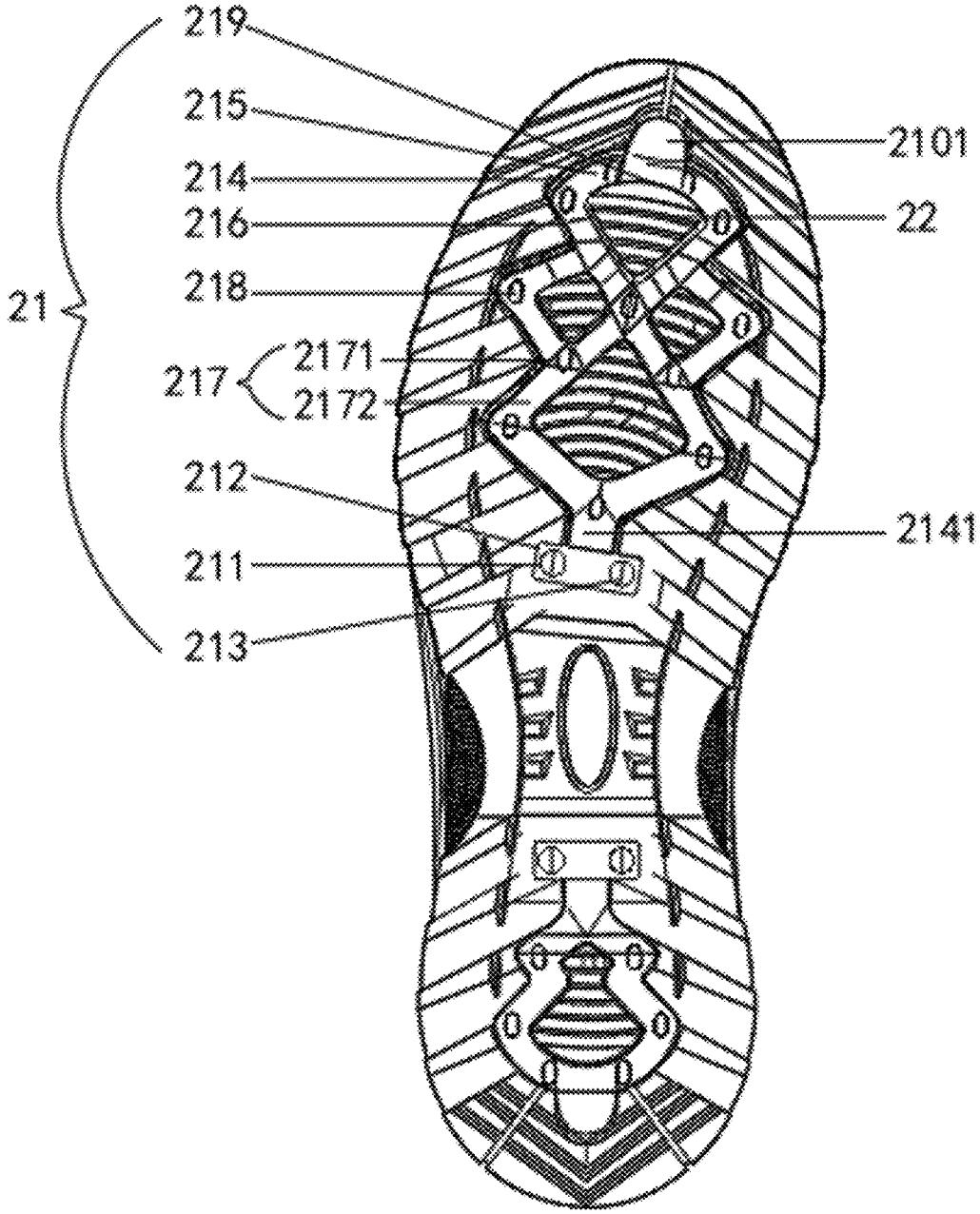
FIG. 8 is a detailed structural diagram of the anti-slip sole.

As shown in FIG. 5, the friction strip 129 is mainly formed by alternately connecting thick protrusion sections 1293 and thin concave sections 1294; the thick protrusion section 1293 and the thin concave section 1294 are connected end to end; The shoe spikes are arranged on the thick protrusion section 1293 of the external rib and the internal cross ribs. In the actual implementation process, when the friction strip 129 is installed in the friction groove section 215, it can effectively fix the friction strip 129, making the installation of the friction strip 129 more secure and reliable. At the same time, when the friction groove section 215 deforms under force, a wavy surface is formed through the thick protrusion section 1293 and the thin concave section 1294, which can effectively increase the friction area and prevent the friction strip 129 from coming out of the friction groove section 215.

The friction strip 129 also comprises a positioning bump 1295 that is arranged on the second end 1292 and extends towards the inside of the positioning hole 128. In the actual implementation process, to prevent the friction part 121 from moving along the spherical surface after installation of the rotating shaft 124, a positioning bump 1295 is arranged on the second end 1292 to fix the second end 1292, thereby making the installation of the friction part 121 more secure and reliable.

The friction strip 129 also comprises an ejection point 1296 located at the second end 1292; the ejection point 1296 is arranged on the first friction surface 125. In the actual implementation process, when the first friction surface 125 faces outward, the ejection point 1296 contacts the ground earlier than the first friction surface 125, supporting the second end 1292 and preventing the second end 1292 from slipping out of the friction groove section 215, effectively protecting the friction strip 129.

The mounting seat 11 comprises a sliding groove part 111 that cooperates with the sphere 123; The sliding groove part 111 has a first opening 112 for the sphere 123 to enter and exit, and a second opening 113 to avoid the rotating shaft 124. The upper part of the sliding groove part 111 is a cylindrical structure, and the lower part is a spherical structure; the second opening 113 limits the sphere 123. In the actual implementation process, the purpose of providing the first opening 112 is to facilitate the assembly of the anti-slip mechanism 12 with the mounting seat 11, allowing for easy and convenient replacement, ensuring that the anti-slip function of the shoe is not lost due to accidents or damage; The second opening 113 is arranged to avoid the rotating shaft 124, and at the same time, the second opening 113 can limit the rotating shaft 124, making the friction part 121 more secure and stable after installation.

The mounting seat 11 is integrally formed. In the actual implementation process, the mounting seat 11 adopts an integrated injection molding method, which saves assembly time and effectively improves the production efficiency of the mounting seat 11, reducing production costs.

The mounting seat 11 also comprises an avoiding arc surface 114 for avoiding the friction part 121, with the angle of the avoiding arc surface 114 being 0-60°, and the angle of rotation of the friction part 121 along the avoiding arc surface 114 being 90-120°. In the actual implementation process, when it is necessary to switch between the first friction surface 125 and the second friction surface, the user can move the second end 1292, causing the rotating shaft 124 to swing along the second opening 113, driving the sphere 123 to rotate, thereby allowing the friction strip 129 to disengage from the friction groove section 215; then rotate the friction strip 129 along the rotating shaft 124; When the rotating shaft 124 swings along the second opening 113, the friction part 121 can move in the direction of the avoiding arc surface 114. The avoiding arc surface 114 can avoid the friction part 121, making the switching process more efficient and smoother.

The mounting seat 11 comprises a clamping cone head 115 for fixed installation. In the actual implementation process, the clamping cone head 115 facilitates the installation and fixation of the mounting seat 11.

Embodiment 2

A rotatable anti-slip device comprises a device main body 1, wherein the device main body 1 comprises a mounting seat 11 and an anti-slip mechanism 12 that is rotatably connected to the mounting seat 11; The anti-slip mechanism 12 comprises a friction part 121 and a rotation part 122 connected to the friction part 121; The rotation part 122 comprises a sphere 123 and a rotating shaft 124 connected between the sphere 123 and the friction part 121; The friction part 121 comprises a first friction surface 125 and a second friction surface 126 opposite to the first friction surface 125; The friction part 121 comprises an anti-slip component 127 provided on the second friction surface 126. In the actual implementation process, by providing the rotation part 122, the anti-slip mechanism 12 can turn over relative to the mounting seat 11; Specifically, by providing the sphere 123, the rotating shaft 124 can rotate along the spherical surface, and at the same time, the rotating shaft 124 is arranged between the sphere 123 and the friction part 121, the rotating shaft 124 can limit the rotation direction, allowing the friction part 121 to turn over along the rotating shaft 124; The friction part 121 has a first friction surface 125 and a second friction surface 126. The user can turn over the friction part 121 according to different terrains to meet the anti-slip requirements of different terrains, effectively improving the anti-slip effect on various terrains.

The anti-slip component 127 comprises shoe spikes or spike stickers. The friction part 121 and rotation part 122 in the anti-slip mechanism 12 are made of TPU material, and the anti-slip component 127 is made of stainless steel. The friction part 121, rotation part 122, and anti-slip component 127 are integrally formed through mold processing. In the actual implementation process, the anti-slip component 127 enhances the grip of the second friction surface 126, effectively improving the anti-slip performance.

The anti-slip mechanism 12 is integrally formed. In the actual implementation process, the anti-slip mechanism 12 adopts an integrated injection molding method, which saves assembly time for parts, effectively improves the production efficiency of the anti-slip mechanism 12 and reduces production costs.

The friction part 121 comprises a positioning hole 128 and a friction strip 129 arranged around the positioning hole 128; the friction strip 129 is connected to the shoe spike. The friction strip 129 comprises a first end 1291 connected to the rotating shaft 124 and a second end 1292 corresponding to the first end 1291. In the actual implementation process, providing the positioning hole 128 can effectively reduce the use of injection molding material, facilitate manufacturing, save the production cost of the friction part 121, and make positioning installation convenient. The design of the friction strip 129 facilitates the bearing of the shoe spike.

The friction part 121 comprises a plurality of positioning holes 128 and a plurality of friction strips 129; The plurality of friction strips 129 are staggered and connected to form external ribs and internal cross ribs. In the actual implementation process, the plurality of positioning holes 128 facilitate installation, and after installation, they make the connection of the friction part 121 more secure and reliable. Meanwhile, the plurality of friction strips 129 are staggered and connected to form internal cross bars that support the friction part 121, effectively enhancing the strength of the friction part 121.

As shown in FIG. 5, the friction strip 129 is mainly formed by alternately connecting thick protrusion sections 1293 and thin concave sections 1294; the thick protrusion section 1293 and the thin concave section 1294 are connected end to end; The shoe spikes are arranged on the thick protrusion section 1293 of the external rib and the internal cross ribs. In the actual implementation process, when the friction strip 129 is installed in the friction groove section 215, it can effectively fix the friction strip 129, making the installation of the friction strip 129 more secure and reliable. At the same time, when the friction groove section 215 deforms under force, a wavy surface is formed through the thick protrusion section 1293 and the thin concave section 1294, which can effectively increase the friction area and prevent the friction strip 129 from coming out of the friction groove section 215.

The friction strip 129 also comprises a positioning bump 1295 that is arranged on the second end 1292 and extends towards the inside of the positioning hole 128. In the actual implementation process, to prevent the friction part 121 from moving along the spherical surface after installation of the rotating shaft 124, a positioning bump 1295 is arranged on the second end 1292 to fix the second end 1292, thereby making the installation of the friction part 121 more secure and reliable.

The friction strip 129 also comprises an ejection point 1296 located at the second end 1292; the ejection point 1296 is arranged on the first friction surface 125. In the actual implementation process, when the first friction surface 125 faces outward, the ejection point 1296 contacts the ground earlier than the first friction surface 125, supporting the second end 1292 and preventing the second end 1292 from slipping out of the friction groove section 215, effectively protecting the friction strip 129.

The mounting seat 11 comprises a sliding groove part 111 that cooperates with the sphere 123; The sliding groove part 111 has a first opening 112 for the sphere 123 to enter and exit, and a second opening 113 for avoiding the rotating shaft 124. The upper part of the sliding groove part 111 is a cylindrical structure, and the lower part is a spherical structure; the second opening 113 limits the sphere 123. In the actual implementation process, the purpose of providing the first opening 112 is to facilitate the assembly of the anti-slip mechanism 12 with the mounting seat 11, allowing for easy and convenient replacement, ensuring that the anti-slip function of the shoe is not lost due to accidents or damage; The second opening 113 is arranged to avoid the rotating shaft 124, and at the same time, the second opening 113 can limit the rotating shaft 124, making the friction part 121 more secure and stable after installation.

The mounting seat 11 is integrally formed. In the actual implementation process, the mounting seat 11 adopts an integrated injection molding method, which saves assembly time and effectively improves the production efficiency of the mounting seat 11, reducing production costs.

The mounting seat 11 also comprises an avoiding arc surface 114 for avoiding the friction part 121, with the angle of the avoiding arc surface 114 being 0-60°, and the angle of rotation of the friction part 121 along the avoiding arc surface 114 being 90-120°. In the actual implementation process, when it is necessary to switch between the first friction surface 125 and the second friction surface, the user can move the second end 1292, causing the rotating shaft 124 to swing along the second opening 113, driving the sphere 123 to rotate, thereby allowing the friction strip 129 to disengage from the friction groove section 215; then rotate the friction strip 129 along the rotating shaft 124; When the rotating shaft 124 swings along the second opening 113, the friction part 121 can move in the direction of the avoiding arc surface 114. The avoiding arc surface 114 can avoid the friction part 121, making the switching process more efficient and smoother. The mounting seat 11 comprises a clamping cone head 115 for fixed installation. In the actual implementation process, the clamping cone head 115 facilitates the installation and fixation of the mounting seat 11.

[All-Terrain Anti-Slip Sole According to the Embodiment of the Present Application]

Embodiment 1

An anti-slip sole, the anti-slip sole comprises a sole body 2 connected to a rotatable anti-slip device; The sole body 2 comprises a mounting groove 21 for installing the rotatable anti-slip device. In the actual implementation process, by providing the mounting groove 21, the installation of the anti-slip device is facilitated.

The mounting groove 21 comprises a seat groove section 211 that cooperates with the mounting seat 11, a limiting stop wall 212 surrounding the outside of the seat groove section 211, and a clamping hole 213 arranged at the bottom of the seat groove section 211; the clamping hole 213 is used to fix the clamping cone head 115. In the actual implementation process, the cooperation between the clamping hole 213 and the clamping cone head 115 facilitates the installation of the mounting seat 11, making the connection of the mounting seat 11 more secure and reliable.

The mounting groove 21 also comprises an anti-slip groove section 214 that cooperates with the anti-slip mechanism 12; The anti-slip groove section 214 comprises a friction groove section 215 that cooperates with the friction strip 129. In the actual implementation process, after the friction strip 129 is installed, it is embedded in the friction groove section 215. The friction groove section 215 facilitates the installation of the friction strip 129 and can also protect the friction strip 129.

The friction groove section 215 comprises a sidewall 216 for limiting the position of the friction strip 129, where the sidewall 216 is higher than the friction strip 129, and the height difference between them is 2-3.5 mm. In the actual implementation process, the limiting effect of the sidewall 216 effectively secures the friction strip 129, making the connection of the friction strip 129 more firm.

The friction groove section also comprises a groove bottom surface 217 for supporting the friction strip 129; The groove bottom surface 217 comprises a concave surface 2171 that matches the thick protrusion section 1293 and a convex surface 2172 that matches the thin concave section 1294. In the actual implementation process, when the friction strip 129 is installed in the friction groove section 215, it can effectively fix the friction strip 129, making the installation of the friction strip 129 more secure and reliable. At the same time, when the friction groove section 215 deforms under force, a wavy surface is formed through the thick protrusion section 1293 and the thin concave section 1294, which can effectively increase the friction area and prevent the friction strip 129 from coming out of the friction groove section 215.

The friction groove section also comprises a socket 218 provided on the groove bottom surface 217; the socket 218 cooperates with the anti-slip component 127. In the actual implementation process, the socket 218 on the friction groove bottom surface 217 can accommodate a shoe spike.

The mounting groove 21 also comprises a positioning bump 219 that cooperates with the positioning hole 128. In the actual implementation process, the cooperation between the positioning hole 128 and the positioning bump 219 facilitates the fixed installation of the friction part 121.

The sole body 2 also comprises a clamping groove 22 provided on the positioning bump 219; the clamping groove 22 cooperates with the positioning bump 1295. In the actual implementation process, the clamping groove 22 cooperates with the positioning bump 1295, ensuring that the friction part 121 is better fixed on the sole, preventing the second end 1292 from coming off.

The anti-slip groove section 214 also comprises a rotation groove section 2141 that cooperates with the rotation part 122; The rotation groove section 2141 is connected between the friction groove section 215 and the seat groove section 211.

After the installation of the anti-slip device, the ejection point 1296 is flush with the bottom surface of the anti-slip sole. In the actual implementation process, the ejection point 1296 is arranged flush with the ground surface of the anti-slip sole. During the contact process between the sole and the ground, the ejection point 1296 will contact the ground before the second end 1292, effectively preventing the unintended detachment of the second end 1292 from the friction groove section 215, thereby ensuring that the anti-slip device is securely and reliably fixed to the anti-slip sole during walking.

The mounting groove 21 also comprises an avoiding groove 2101, wherein the friction groove section 215 is connected between the avoiding groove 2101 and the rotation groove section 2141. In the actual implementation process, the avoiding groove 2101 can accommodate a finger for easy removal of the second end 1292, which facilitates the switch between the first friction surface 125 or the second friction surface 126.

The sole body 2 comprises more than two mounting grooves 21. In the actual implementation process, one mounting groove 21 can be arranged at the heel, and another mounting groove 21 can be arranged at the shoe vamp, which allows one sole to be equipped with two rotatable anti-slip devices for better effectiveness.

Embodiment 2

An anti-slip sole, the anti-slip sole comprises a sole body 2 connected to a rotatable anti-slip device; The sole body 2 comprises a mounting groove 21 for installing the rotatable anti-slip device. In the actual implementation process, by providing the mounting groove 21, the installation of the anti-slip device is facilitated.

The mounting groove 21 comprises a seat groove section 211 that cooperates with the mounting seat 11, a limiting stop wall 212 surrounding the outside of the seat groove section 211, and a clamping hole 213 arranged at the bottom of the seat groove section 211; the clamping hole 213 is used to fix the clamping cone head 115. In the actual implementation process, the cooperation between the clamping hole 213 and the clamping cone head 115 facilitates the installation of the mounting seat 11, making the connection of the mounting seat 11 more secure and reliable.

The mounting groove 21 also comprises an anti-slip groove section 214 that cooperates with the anti-slip mechanism 12; The anti-slip groove section 214 comprises a friction groove section 215 that cooperates with the friction strip 129. In the actual implementation process, after the friction strip 129 is installed, it is embedded in the friction groove section 215. The friction groove section 215 facilitates the installation of the friction strip 129 and can also protect the friction strip 129.

The friction groove section 215 comprises a sidewall 216 for limiting the friction strip 129, where the sidewall 216 is higher than the friction strip 129, and the height difference between them is 2-3.5 mm. In the actual implementation process, the limiting effect of the sidewall 216 effectively secures the friction strip 129, making the connection of the friction strip 129 more firm.

The friction groove section also comprises a groove bottom surface 217 for supporting the friction strip 129; The groove bottom surface 217 comprises a concave surface 2171 that matches the thick protrusion section 1293 and a convex surface 2172 that matches the thin concave section 1294. In the actual implementation process, when the friction strip 129 is installed in the friction groove section 215, it can effectively fix the friction strip 129, making the installation of the friction strip 129 more secure and reliable. At the same time, when the friction groove section 215 deforms under force, a wavy surface is formed through the thick protrusion section 1293 and the thin concave section 1294, which can effectively increase the friction area and prevent the friction strip 129 from coming out of the friction groove section 215.

The friction groove section also comprises a socket 218 provided on the groove bottom surface 217; the socket 218 cooperates with the anti-slip component 127. In the actual implementation process, the socket 218 on the friction groove bottom surface 217 can accommodate a shoe spike.

The mounting groove 21 also comprises a positioning bump 219 that cooperates with the positioning hole 128. In the actual implementation process, the cooperation between the positioning hole 128 and the positioning bump 219 facilitates the fixed installation of the friction part 121.

The sole body 2 also comprises a clamping groove 22 provided on the positioning bump 219; the clamping groove 22 cooperates with the positioning bump 1295. In the actual implementation process, the clamping groove 22 cooperates with the positioning bump 1295, ensuring that the friction part 121 is better fixed on the sole, preventing the second end 1292 from coming off.

The anti-slip groove section 214 also comprises a rotation groove section 2141 that cooperates with the rotation part 122; The rotation groove section 2141 is connected between the friction groove section 215 and the seat groove section 211.

After the installation of the anti-slip device, the ejection point 1296 is flush with the bottom surface of the anti-slip sole. In the actual implementation process, the ejection point 1296 is arranged flush with the ground surface of the anti-slip sole. During the contact process between the sole and the ground, the ejection point 1296 will contact the ground before the second end 1292, effectively preventing the unintended detachment of the second end 1292 from the friction groove section 215, thereby ensuring that the anti-slip device is securely and reliably fixed to the anti-slip sole during walking.

The mounting groove 21 also comprises an avoiding groove 2101; The friction groove section 215 is connected between the avoiding groove 2101 and the rotation groove section 2141. In the actual implementation process, the avoiding groove 2101 can accommodate a finger for easy removal of the second end 1292, facilitating the switch between the first friction surface 125 or the second friction surface 126.

Preferably, the sole body 2 comprises more than two mounting grooves 21. In the actual implementation process, a mounting groove 21 can be arranged at the heel, and several other mounting grooves 21 can be arranged at the shoe vamp. A sole can be equipped with more than two rotatable anti-slip devices, providing better effectiveness.

[Usage Method of the All-Terrain Anti-Slip Sole According to the Embodiment of the Present Application]

Usage Method of the All-Terrain Anti-Slip Sole on Snow

When used on snow, by providing the rotation part 122, the anti-slip mechanism 12 can turn over relative to the mounting seat 11; Specifically, by providing the sphere 123, the rotating shaft 124 can rotate along the spherical surface, and at the same time, the rotating shaft 124 is arranged between the sphere 123 and the friction part 121, the rotating shaft 124 can limit the rotation direction, allowing the friction part 121 to turn over along the rotating shaft 124; The friction part 121 has a first friction surface 125 and a second friction surface 126. The user can adjust the turning over of the friction part 121 according to different terrains to adapt to snow, effectively improving the anti-slip effect on snow.

Method B for Using All-Terrain Anti-Slip Sole in Wetlands

When used in wetlands, the rotation part 122 is arranged so that the anti-slip mechanism 12 can turn over relative to the mounting seat 11; Specifically, by providing the sphere 123, the rotating shaft 124 can rotate along the spherical surface, and at the same time, the rotating shaft 124 is arranged between the sphere 123 and the friction part 121, the rotating shaft 124 can limit the rotation direction, allowing the friction part 121 to turn over along the rotating shaft 124; The friction part 121 has a first friction surface 125 and a second friction surface 126. The user can adjust the friction part 121 by turning over it according to different terrains to adapt to wetlands, effectively improving the anti-slip effect on wetlands.

Assembly/Replacement Method C for All-Terrain Anti-Slip Sole

During assembly, embed the entire anti-slip mechanism 12 into the anti-slip groove section 214, then insert the mounting seat 11 into the seat groove section 211. As the clamping cone head 115 on the mounting seat 11 snaps into the clamping hole 213 within the seat groove section 211, the sphere 123 on the anti-slip mechanism 12 is embedded through the first opening 112 of the mounting seat 11 and slides along the cylindrical structure at the upper part of the sliding groove part 111 to the spherical structure at the lower part for rotational limiting. The rotating shaft 124 will fit into the second opening 113 of the mounting seat 11, allowing the mounting seat 11 and the anti-slip mechanism 12 to be embedded into the sole, completing the assembly work. The use of a single-axis positioning structure enhances the convenience of the assembly work, allowing for easy and convenient replacement without losing the shoe's anti-slip function due to accidents or damage. During replacement, pull the anti-slip device out of the mounting groove 21 with force, then use the above steps. After the anti-slip mechanism 12 is assembled, press the mounting seat 11 into the seat groove section 211 with a tool or by hand, and fix the rotation part 122 of the anti-slip mechanism 12 to complete the installation and replacement work.

The above description is merely an embodiment of the present application and does not limit the patent scope of the present application. Any equivalent transformation made using the content of the specification and drawings of the present application, or any direct or indirect application in related technical fields, is similarly comprised within the patent protection scope of the present application.

What is claimed is:

1. A rotatable anti-slip device, comprising a device main body (1), characterized in that the device main body (1) comprises a mounting seat (11) and an anti-slip mechanism (12) rotatably connected to the mounting seat (11), wherein the anti-slip mechanism (12) comprises a friction part (121) and a rotation part (122) connected to the friction part (121), wherein the rotation part (122) comprises a sphere (123) and a rotating shaft (124) connected between the sphere (123) and the friction part (121), wherein the friction part (121) comprises a first friction surface (125) and a second friction surface (126) facing opposite to the first friction surface (125), and the friction part (121) comprises anti-slip components (127) arranged on the second friction surface (126); the mounting seat (11) comprises a sliding groove part (111) that cooperates with the sphere (123), an upper part of the sliding groove part (111) is configured to be a cylindrical structure, and a lower part is configured to be a spherical structure, wherein the sliding groove part (111) has a first opening (112) for the sphere (123) to enter and exit, and a second opening (113) for avoiding the rotating shaft (124) and the second opening (113) is configured to limit the position of the sphere (123); the mounting seat (11) also comprises an avoiding arc surface (114) for avoiding the friction part (121).

2. The rotatable anti-slip device according to claim 1, characterized in that the anti-slip components (127) comprise shoe spikes or spike stickers.

3. The rotatable anti-slip device according to claim 2, characterized in that the friction part (121) and the rotation part (122) in the anti-slip mechanism (12) are made of TPU material, the anti-slip components (127) are made of either tungsten steel or stainless steel, and the friction part (121), rotation part (122), and anti-slip components (127) are integrally formed by mold processing, wherein the friction part (121) comprises positioning holes (128) and friction strips (129) arranged around the positioning hole (128); the friction strips (129) are connected to the shoe spike; the friction strip (129) comprises a first end (1291) connected to the rotating shaft (124) and a second end (1292) corresponding to the first end (1291).

4. The rotatable anti-slip device according to claim 3, characterized in that the friction part (121) comprises a plurality of positioning holes (128) and a plurality of friction strips (129), wherein the plurality of friction strips (129) are staggered and connected to form external ribs and internal cross ribs.

5. The rotatable anti-slip device according to claim 4, characterized in that the friction strip (129) is mainly formed by alternately connecting thick protrusion sections (1293) and thin concave sections (1294), wherein the thick protrusion section (1293) and the thin concave section (1294) are connected end to end, and the shoe spikes are arranged on the thick protrusion sections (1293) on the external ribs and internal cross ribs.

6. The rotatable anti-slip device according to claim 3, characterized in that the friction strip (129) further comprises a positioning bump (1295) provided on the second end (1292) and extending towards the interior of the positioning hole (128), and an ejection point (1296) provided at the second end (1292), wherein the ejection point (1296) is arranged on the first friction surface (125).

7. The rotatable anti-slip device according to claim 6, characterized in that the mounting seat (11) is integrally formed, wherein the angle of the avoiding arc surface (114) is 0-60°, and the angle of rotation of the friction part (121) along the avoiding arc surface (114) is 90-120°.

8. The rotatable anti-slip device according to claim 1, characterized in that the mounting seat (11) comprises a clamping cone head (115) for fixed installation.

9. An all-terrain anti-slip sole, comprising the rotatable anti-slip device according to claim 1, characterized in that the anti-slip sole comprises a sole body (2) connected to the rotatable anti-slip device, wherein the sole body (2) comprises a mounting groove (21) for installing the rotatable anti-slip device.

10. The all-terrain anti-slip sole according to claim 9, characterized in that the mounting groove (21) comprises a seat groove section (211) that cooperates with the mounting seat (11), a limiting stop wall (212) surrounding the outside of the seat groove section (211), and a clamping hole (213) arranged at the bottom of the seat groove section (211), wherein the clamping hole (213) is configured to fix the clamping cone head (115).

11. The all-terrain anti-slip sole according to claim 10, characterized in that the mounting groove (21) further comprises an anti-slip groove section (214) that cooperates with the anti-slip mechanism (12), wherein the anti-slip groove section (214) comprises a friction groove section (215) that cooperates with the friction strip (129).

12. The all-terrain anti-slip sole according to claim 11, characterized in that the friction groove section (215) comprises a sidewall (216) for limiting the position of the friction strip (129), wherein the sidewall (216) is higher than the friction strip (129), and the height difference between them is 2-3.5 mm.

13. The all-terrain anti-slip sole according to claim 12, characterized in that the friction groove section (215) further comprises a groove bottom surface (217) for supporting the friction strip (129), wherein the groove bottom surface (217) comprises a concave surface (2171) that cooperates with the thick protrusion section (1293) and a convex surface (2172) that cooperates with the thin concave section (1294).

14. The all-terrain anti-slip sole according to claim 13, characterized in that the friction groove section (215) further comprises sockets (218) provided on the groove bottom surface (217), wherein the socket (218) cooperates with the anti-slip component (127).

15. The all-terrain anti-slip sole according to claim 14, characterized in that the mounting groove (21) further comprises a positioning bump (219) that cooperates with the positioning hole (128).

16. The all-terrain anti-slip sole according to claim 15, characterized in that the sole body (2) further comprises a clamping groove (22) provided on the positioning bump (219), wherein the clamping groove (22) cooperates with the positioning bump (1295).

17. The all-terrain anti-slip sole according to claim 16, characterized in that the anti-slip groove section (214) further comprises a rotation groove section (2141) that cooperates with the rotation part (122), wherein the rotation groove section (2141) is connected between the friction groove section (215) and the seat groove section (211).

18. The all-terrain anti-slip sole according to claim 17, characterized in that after the anti-slip device is installed, the ejection point (1296) is flush with the bottom surface of the anti-slip sole.

19. The all-terrain anti-slip sole according to claim 18, characterized in that the mounting groove (21) further comprises an avoiding groove (2101), wherein the friction groove section (215) is connected between the avoiding groove (2101) and the rotation groove section (2141).

20. The all-terrain anti-slip sole according to claim 19, characterized in that the sole body (2) comprises more than two mounting grooves (21).

* * * * *